US007125190B2

(12) United States Patent
England

(10) Patent No.: US 7,125,190 B2
(45) Date of Patent: Oct. 24, 2006

(54) RING BINDER ASSEMBLY DEVICE TO INSURE THE PERFECTED CLOSURE OF BINDER RINGS

(76) Inventor: John William England, 225 Via Condado, Palm Beach Gardens, FL (US) 33418

( * ) Notice: Subject to any disclaimer, the term of this patent is extended or adjusted under 35 U.S.C. 154(b) by 237 days.

(21) Appl. No.: 10/767,393

(22) Filed: Jan. 28, 2004

(65) Prior Publication Data

US 2005/0163557 A1 Jul. 28, 2005

(51) Int. Cl.
*B42F 13/00* (2006.01)

(52) U.S. Cl. ..... 402/73

(58) Field of Classification Search ..... 281/21.1, 281/27.1, 28; 402/4, 13, 50, 58, 80 R; 403/327; 24/598.2, 16 PB See application file for complete search history.

(56) References Cited

U.S. PATENT DOCUMENTS

| | | | | | |
|---|---|---|---|---|---|
| 805,575 | A | * | 11/1905 | Morden | 402/68 |
| 826,656 | A | * | 7/1906 | Gerow | 40/119 |
| 1,664,198 | A | * | 3/1928 | Dvorak | 24/708.5 |
| 1,885,461 | A | * | 11/1932 | Mcmillan | 402/44 |
| 4,519,504 | A | * | 5/1985 | Nausedas | 206/554 |
| 4,690,580 | A | | 9/1987 | Kissel | |
| 5,765,956 | A | | 6/1998 | Lanzarin | |
| 6,146,049 | A | * | 11/2000 | Faris | 403/326 |

* cited by examiner

*Primary Examiner*—Jacob K. Ackun
*Assistant Examiner*—J Williams
(74) *Attorney, Agent, or Firm*—McHale & Slavin PA

(57) ABSTRACT

The invention provides a ring binder assembly device to insure the perfected closure of loose leaf binder rings. Enclosure of binder rings with the device of the invention will repair and prevent ring misalignment.

10 Claims, 4 Drawing Sheets

RING BINDER ASSEMBLY DEVICE TO INSURE THE PERFECTED CLOSURE OF BINDER RINGS

FIELD OF THE INVENTION

The instant invention relates generally to ring mechanisms of loose leaf binders and particularly to a ring binder assembly device for repairing and preventing misalignment of the rings in a loose leaf binder.

BACKGROUND OF THE INVENTION

Ring binders are well-known tools for storing, displaying and organizing paper and other similar materials and are useful in a variety of settings; for example, in schools and offices. Ring binders are produced in many different shapes, styles and sizes for both aesthetic and functional purposes. The size is usually dependent upon the diameter of the ring closures, non-limiting examples include, ring closures of a half-inch, one inch, one and a half inches, 2 inches, 3 inches, 4 inches and 5 inches in diameter. Additionally, the rings can be crafted into various shapes for different purposes, non-limiting examples include, D-ring and continuous curvature.

While binders can be crafted in a variety of shapes, styles and sizes; they all generally share the same common binder ring mechanism. This mechanism is usually spring-loaded and when engaged will quickly and efficiently clamp together to join opposing sides of the rings of the binder. However, due to the pressure exerted on the spring mechanism from repeated use, part and/or all of the ring and/or rings move out of alignment and cease to clamp tightly together. The ease of sifting through the contents of the ring binder is impaired and items may be lost from the binder due to slipping out from misaligned rings. This misalignment of the rings essentially destroys the function of the binder.

Without a quick and/or easy method of repair, the owner of the binder often purchases a replacement, costing both time and money. Thus, there remains a need in the art to mend this fundamental weakness in the design of ring binders by repairing and preventing misalignment of the rings, extending the "life" of the binder and saving the owner both time and money.

DESCRIPTION OF THE PRIOR ART

U.S. Pat. No. 4,690,580 discloses a ring binder mechanism of the type referred to wherein the ring portions are reliably adjusted on all sides in their closed position even with heavy loading and are secured against opening of the ring closure by displacement of the ends of the ring portions.

U.S. Pat. No. 5,765,956 discloses a device for perfected closure of the mechanism having flat rings for containers of mobile sheets (binders). The device comprises rings and screws which are formed with a single presswork operation together with a strip to be placed at the disposal of the user. The latter with simple coin screws within suitable orifices formed on the strip, the latter being fixed to the internal surface of the folder. There is also provided that each ring may be closed simply by causing projections which are formed on the base of each ring to penetrate within shaped grooves, the latter being formed at the opposite end of the same ring, an operation which is easy due to the elasticity of the material which constitutes the rings.

SUMMARY OF THE INVENTION

The instant invention provides a ring binder assembly device that can both prevent misalignment of binder rings and repair binder rings which have become misaligned. The device of the preferred invention is both a resilient and flexible structure which substantially surrounds the existing binder rings. The device is comprised of at least two hollow tubes of continuous curvature which engage upon closing of the rings to form a single unit. The hollow tubes are sized to substantially cover the entire underlying binder ring and each can be formed as unitary or segmented elements. Since it has been theorized that a funnel-shape can guide a smaller object to a specific point, one end of one of the hollow tubes is molded into a funnel-shape. Through use of this funnel-shape, the device of the instant invention renders it possible to guide one part of a ring to the other part of the ring, thus preventing misalignment and forcing the rings to realign properly should they be out of place.

Accordingly, it is an objective of the instant invention to provide a device which prevents misalignment of binder rings.

It is a further objective of the instant invention to provide a device which repairs binder rings which have become misaligned.

It is a still further objective of the instant invention to provide a device which can repair and/or prevent misalignment of binder rings.

It is yet another objective of the instant invention to provide kits for preventing and repairing misalignment of binder rings comprising the engagement elements of the device of the instant invention.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE FIGURES

FIG. 3B is a transverse section of the device surrounding the ring shown in FIG. 3A illustrating the exterior and interior layers of the device of the instant invention.

DEFINITIONS AND ABBREVIATIONS

The following list defines terms, phrases and abbreviations used throughout the instant specification. Although the terms, phrases and abbreviations are listed in the singular tense the definitions are intended to encompass all grammatical forms.

As used herein, the term "loose-leaf" refers to sheets of paper or other similar material which are unbound, mobile and contain holes for insertion into ring binders.

As used herein, the term "existing binder ring" refers to an individual ring mechanism present in a ring binder made of metals, plastics or other similar materials; usually a binder has three existing binder rings.

As used herein, the term "substantially covering" refers to an amount of covering of the length of an existing binder ring by the elements of the device of the instant invention sufficient to insure that the papers inserted into the ring can be easily flipped through without snagging or becoming caught on the device.

DETAILED DESCRIPTION OF THE INVENTION

This invention provides a device for correction and prevention of the most common problem of ring binders, misalignment of the rings with repeated use.

Figure 1:
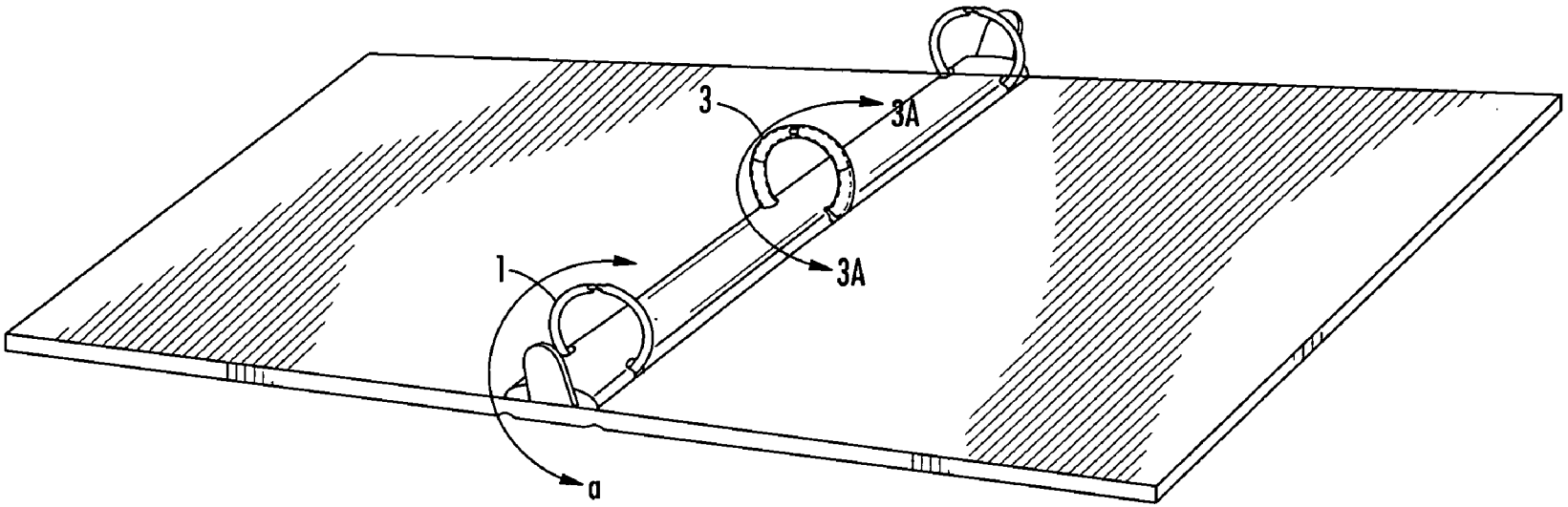
FIG. 1 is a general view of a ring binder having the device of the instant invention surrounding the second of three rings.
Figure 2:
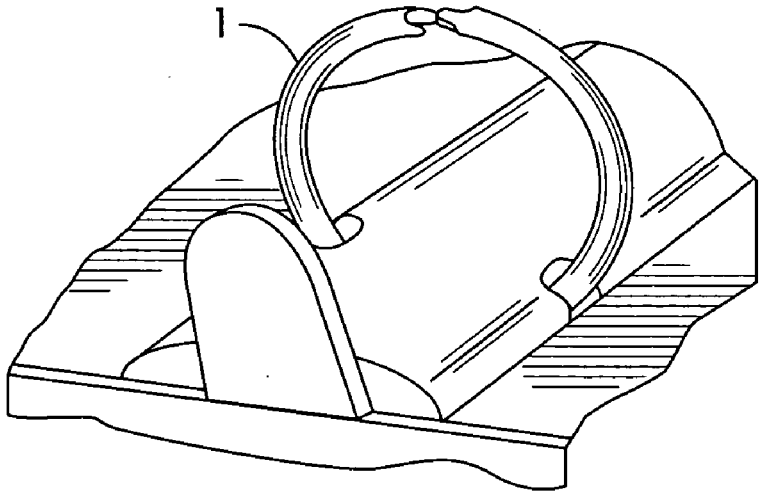
FIG. 2 PRIOR ART
FIG. 2 is a broken-away view of the third ring of the binder of FIG. 1; illustrating a close-up view of the ring binder mechanism known in the prior art.
Figure 3A:
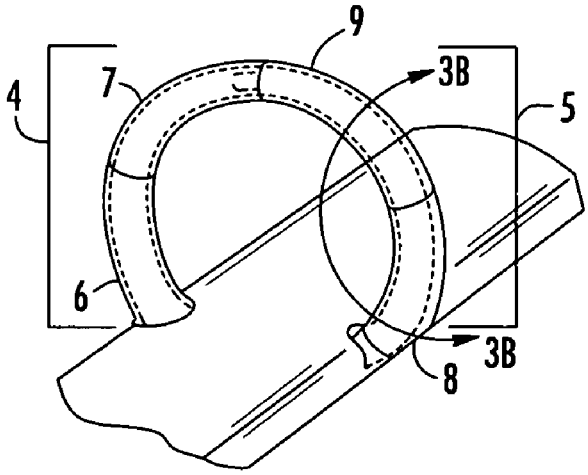
FIGS. 3A–B FIG. 3A is a broken-away view of the second ring of the binder of FIG. 1; illustrating a close-up view of the ring surrounded by the device of the instant invention.

A standard continuous curvature binder ring is the most frequently utilized shape of binder ring and is the shape typically surrounded by the ring binder assembly device of the instant invention. An example of such a binder ring is shown in FIGS. 1 and 2, labeled as number 1. FIG. 1 shows a general view of a ring binder and FIG. 2 shows a broken-away view of the portion of FIG. 1 labeled by line 2. FIG. 2 displays a close-up version of the ring binder mechanism known in the prior art. A binder ring surrounded by the device of the instant invention is labeled number 3 in FIG. 1. FIG. 3A shows a broken-away view of this portion of FIG. 1 labeled by line 3A. FIG. 3A displays a close-up view of a binder ring surrounded by the device of the instant invention. The device of the instant invention is composed of at least two elements, labeled numbers 4 and 5 in FIG. 3A, each a hollow tube having a shape conforming to the curvature of the binder ring which the device will surround. The at least two elements can be of unitary or segmented construction; for example, elements 4 and 5 represent continuous unitary construction wherein each element substantially covers half of the length of an existing binder ring and elements 6, 7, 8 and 9 shown in FIG. 3A represent segmented construction wherein each element substantially covers about a quarter of the length of an existing binder ring. Thus, as shown in FIG. 3A, elements 6 and 7 are engaged to form element 4 and elements 8 and 9 are engaged to form element 5, elements 4 and 5 are then engaged to form the device of the instant invention. The device is often segmented into four elements to facilitate sliding around the existing binder ring during device installation. The device, when completely assembled, should have a diameter of about one to two millimeters greater than the diameter of the existing binder ring for an appropriate fit to insure both proper functioning of the device and substantial covering of the existing binder ring when the ring is in a closed position. This is accomplished by increasing the length of elements 4 and 5 to exceed the length of one half of the existing binder ring in the closed position to insure that elements 4 and 5 are in axial alignment when the device is engaged.

Figure 3B:
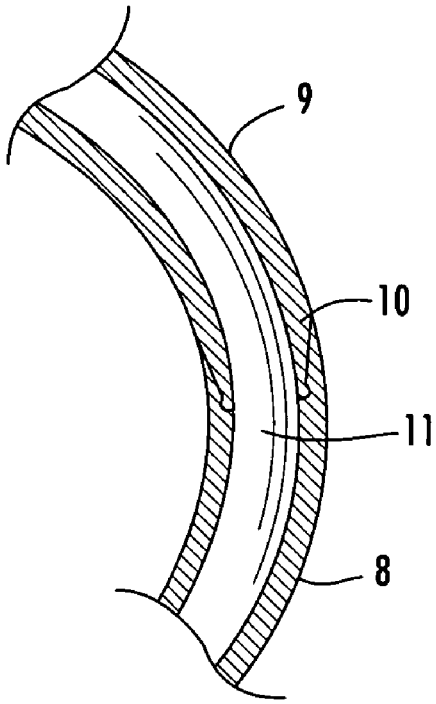

Elements 4 and 5, whether of unitary or segmented construction, are continuous curvature hollow tubes comprising an exterior shell constructed of metal or polymeric material and preferably includes an inner layer of rubber or other elastomeric material. FIG. 3B illustrates element 5 of the device cut transversely to show both the exterior polymeric surface and the elastomeric inner layer, labeled as numbers 10 and 11 respectively in FIG. 3B. The section of FIG. 3A shown in detail in FIG. 3B is labeled with line 3B in FIG. 3A. The material of the exterior surface must be durable enough to withstand pressure from the spring loaded mechanism when the mechanism is opening and closing but not too rigid to prevent the device from easily sliding over the existing binder rings. The interior coating is frequently necessary to prevent excessive degrees of movement of the device after installation since excessive movement may impair the function of the device. The fit of the device to the existing binder ring should be sufficiently secure to properly guide each half of the existing binder ring into place in a closed position. The elastomeric material coating the interior of the hollow tubes should also be flexible enough so as not to impede the sliding of the device over the existing binder rings during installation and may further include a thin layer of adhesive for increased adherance to the binder ring. The elastomeric inner layer should be one millimeter or less in width to allow sufficient space for secure enclosure of the existing binder rings.

Figure 4:
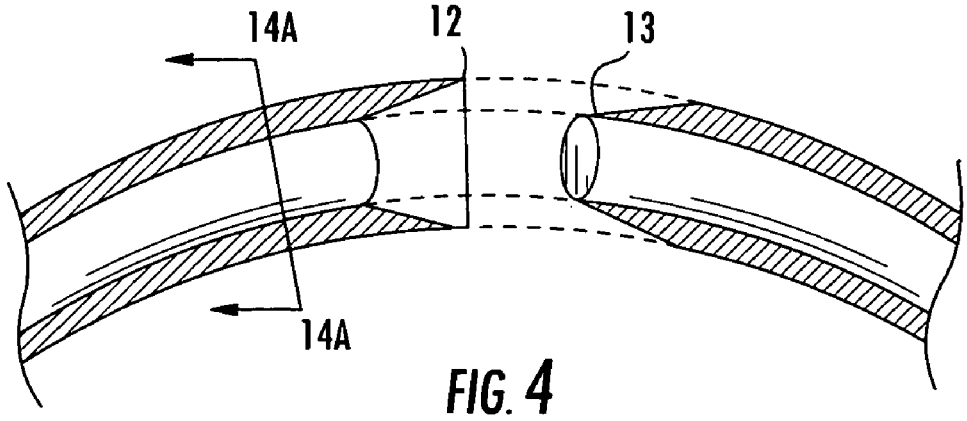
FIG. 4 shows a close-up view of a portion of the device separated to illustrate the pieces which engage to secure the device in place surrounding the binder ring.
Figure 5:
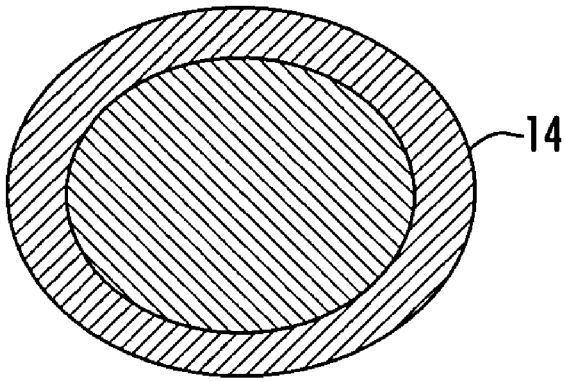
FIG. 5 shows a cross-section of a portion of the piece of the device as shown in FIG. 4.

The engagement of the two opposing elements 4 and 5 gives the device the ability to repair and prevent misalignment of binder rings. One end of element 4 (or element 7 if the device is of segmented construction) is crafted into a funnel shape. Utilization of the funnel shape enables the device of the invention to guide one half of an existing binder ring to the other half of the ring in axial alignment, thus preventing misalignment and forcing the rings to realign properly should they be out of place. The funnel-shaped end has an increased diameter as compared with the diameter of the straight-edged end, preferably an increase of at least about 4 millimeters. FIG. 4 is a close-up view of the opposing ends of elements 4 and 5 in a separated position. Elements 4 and 5 are constructed and arranged for juxtaposed circumferential engagement. FIG. 4 shows the funnel-shaped end labeled number 12 and the straight-edged end labeled number 13. Ends 12 and 13 represent male-female mating portions which engage uniformly upon closing of the ring to substantially cover the existing binder ring to prevent and/or repair ring misalignment. FIG. 5 shows a cross-section of element 4 labeled number 14. The location of the cut of the cross-section is indicated by line 14A in FIG. 4.

The engagement elements that compose the ring binder assembly device of the instant invention can be conveniently packaged as kits. The engagement elements included within the kits can be of unitary construction, segmented construction or a combination of constructions. Additionally, the engagement elements can be sized for binder rings differing in circumference, for example, but not limited to, binder rings of a half inch, one inch, one and a half inches, two inches, three inches, four inches or five inches. Kits can be packaged including engagement elements of one circumference or of different circumferences.

In this manner, the ring binder assembly device of the instant invention extends the useful "life" of ring binders.

All patents and publications mentioned in this specification are indicative of the levels of those skilled in the art to which the invention pertains. All patents and publications are herein incorporated by reference to the same extent as if each individual publication was specifically and individually indicated to be incorporated by reference. It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification. One skilled in the art will readily appreciate that the present invention is well adapted to carry out the objectives and obtain the ends and advantages mentioned, as well as those inherent therein. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A kit for providing uniform engagement of mating portions of a ring binder assembly, each mating portion of said ring binder assembly having a length and a circumference comprising;

a first engagement element constructed and arranged for juxtaposed circumferential engagement about the entire length of a first mating portion of said ring binder assembly;

a second engagement element constructed and arranged for juxtaposed circumferential engagement about the entire length of a second mating portion of said ring binder assembly;

each of said first and second engagement elements being of a length and configuration to insure axial alignment of said mating portions upon closure of said ring binder assembly.

2. The kit of claim 1 wherein each of said first and second engagement elements is of unitary construction.

3. The kit of claim 1 wherein each of said first and second engagement elements is of segmented construction.

4. The kit of claim 1 wherein each of said engagement elements is constructed of a polymeric material.

5. The kit of claim 4 wherein each of said engagement elements further includes an elastomeric inner layer.

6. The kit of claim 5 wherein said elastomeric inner layer includes an adhesive inner layer.

7. The kit of claim 1 wherein each of said engagement elements is constructed of a metal material.

8. The kit of claim 7 wherein each of said engagement elements further includes an elastomeric inner layer.

9. The kit of claim 8 wherein said elastomeric inner layer includes an adhesive inner layer.

10. The kit as in any one of the proceeding claims, in which, said first and second engagement elements are sized for use with binder rings selected from the group of diameters consisting of a half inch, one inch, one and a half inches, two inches, three inches, four inches and five inches.

* * * * *